US009954314B2

(12) United States Patent
Mozer et al.

(10) Patent No.: US 9,954,314 B2
(45) Date of Patent: Apr. 24, 2018

(54) ELECTRICAL CONNECTOR HAVING A LOCKING AND EXTRACTION DEVICE WITH MOBILE GRIPPING JAWS MOUNTED ON A PIVOT AND ACTUATED BY A LEVER FOR ROTATION

(71) Applicant: THALES, Courbevoie (FR)

(72) Inventors: Laurent Mozer, Merignac (FR); Philippe Mateos, Creon (FR); Daniel Laret, Saint Medard en Jailes (FR)

(73) Assignee: Thales, Courbevoie (FR)

( * ) Notice: Subject to any disclaimer, the term of this patent is extended or adjusted under 35 U.S.C. 154(b) by 0 days.

(21) Appl. No.: 15/338,284

(22) Filed: Oct. 28, 2016

(65) Prior Publication Data

US 2017/0125943 A1 May 4, 2017

(30) Foreign Application Priority Data

Oct. 30, 2015 (FR) ..... 15 02293

(51) Int. Cl.
*H01R 13/62* (2006.01)
*H01R 13/629* (2006.01)
*H01R 13/639* (2006.01)

(52) U.S. Cl.
CPC . *H01R 13/62955* (2013.01); *H01R 13/62966* (2013.01); *H01R 13/639* (2013.01)

(58) Field of Classification Search
CPC ..... H01R 13/62955; H01R 13/635; H01R 13/639; H01R 13/62966; H01R 13/62933;
(Continued)

(56) References Cited

U.S. PATENT DOCUMENTS 4,232,926 A * 11/1980 Inouye ..... H05K 7/1409 439/157
5,139,430 A * 8/1992 Lewis ..... H01R 12/7005 439/157

(Continued)

FOREIGN PATENT DOCUMENTS

| | | |
|---|---|---|
| FR | 2 424 643 A1 | 11/1979 |
| GB | 2 028 014 A | 2/1980 |
| JP | S48 99440 U | 11/1973 |

OTHER PUBLICATIONS

French Search Report for French Counterpart Application No. FR 1502293, 6 pgs. (Apr. 30, 2016).

*Primary Examiner* — Chandrika Prasad
(74) *Attorney, Agent, or Firm* — Womble Bond Dickinson (US) LLP

(57) ABSTRACT

The general field of the invention is that of the locking and extraction devices for an electrical connector in an electronic casing, said electronic casing comprising the electrical socket corresponding to said electrical connector, the connection and the extraction of the electrical connector being performed in a determined direction, parallel to the electrical contacts of the electrical connector. The connector according to the invention is mounted in a mechanical assembly comprising at least one shoulder. The electronic casing comprises a mechanical structure comprising at least one mobile gripping jaw arranged so as to grasp the shoulder of the connector and to impart thereon a translational movement in said determined direction, thus facilitating the connection or the extraction of said electrical connector in its electrical socket.

4 Claims, 4 Drawing Sheets

(58) Field of Classification Search
CPC ..... H01R 13/62938; H01R 13/633; H01R 13/6335
USPC ..... 439/153, 157, 159, 160, 352
See application file for complete search history.

(56) References Cited

U.S. PATENT DOCUMENTS 6,056,567 A * 5/2000 Schell ..... H01R 12/7005 439/160
6,572,391 B2 * 6/2003 Mochizuki ..... H01R 13/62972 439/157
6,582,241 B1 * 6/2003 Lutz, Jr. ..... H01R 12/7005 439/157
6,592,384 B2 * 7/2003 Sawayanagi ..... H01R 13/5202 439/157
6,626,688 B1 * 9/2003 Mullady ..... H05K 5/0295 361/727
7,267,563 B2 * 9/2007 Stowers ..... H01R 13/62966 439/157
7,431,598 B2 * 10/2008 Ikeya ..... H01R 13/62938 439/160
7,575,451 B1 * 8/2009 Jaramillo ..... H01R 12/7005 439/157
8,025,513 B2 * 9/2011 Kobayashi ..... H01R 13/62966 439/157
8,366,464 B1 * 2/2013 Figuerado ..... G06F 1/185 439/160
2002/0090851 A1 * 7/2002 Wrycraft ..... H05K 7/1409 439/159

* cited by examiner

ELECTRICAL CONNECTOR HAVING A LOCKING AND EXTRACTION DEVICE WITH MOBILE GRIPPING JAWS MOUNTED ON A PIVOT AND ACTUATED BY A LEVER FOR ROTATION

FIELD

The field of the invention is that of the electrical and mechanical connection devices for electronic equipment items in racks that make it possible to ensure a secure connection. The preferred field of application is that of aeronautics and in particular that of aircraft instrument panels comprising a plurality of display screens. However, this device can have a large number of applications, particularly in all the fields of professional electronics which require secure connections.

BACKGROUND

An aircraft instrument panel electronic equipment item generally comprises a connector on its rear face comprising several dozen electrical contacts. Consequently, the mounting of this connector involves both great accuracy and a certain insertion force.

Currently, there are various mechanical and electrical connection systems that make it possible to ensure this mounting of equipment in conditions of electrical and mechanical security and of resistance to the environments required for aeronautical equipment items. These systems also meet the specific requirements of mounting on an instrument panel regarding in particular the ease and speed of mounting.

A first device consists in putting in place, in the instrument panel, a fixed rack or "seat" 3 comprising the connection system suited to the connector of the equipment item. This seat also comprises mechanical translational guiding means making it possible to correctly pre-position the electronic equipment item when it is being fixed to the instrument panel. Once positioned on the instrument panel, the equipment item is generally locked by means of a fixing handle which ensures both the mechanical fixing of the equipment item and the securing of the electrical contact between the two connectors.

This connection system presents a number of drawbacks. It is done blind, the rear of the casing no longer being accessible during connection. Also, it requires the installation of significant and complex mechanical means, given the level of accuracy required and the dimensions of the casings.

A second solution consists in separately performing the electrical connection and the mechanical connection, in this case, the female connector of the instrument panel is mounted on an electrical pigtail that is sufficiently long. The connector of the equipment item is first of all fixed to this female connector. Once the electrical connection is established, the electronic equipment item is mounted in the instrument panel. The drawback with this solution is that the connection of the two connectors requires a certain force for the locking or unlocking thereof. Without outside assistance, this force is difficult to exert in as much as it is essential not to exert significant pulling force on the electrical pigtail to avoid damaging it.

SUMMARY

The electrical connector locking and extraction device according to the invention does not present these drawbacks. It comprises mechanical means facilitating these various connection mounting operations. More specifically, the subject of the invention is a locking and extraction device for an electrical connector in an electronic casing, said electronic casing comprising the electrical socket corresponding to said electrical connector, the connection and the extraction of the electrical connector being performed in a determined direction, parallel to the electrical contacts of the electrical connector, characterized in that, said connector being mounted in a mechanical assembly comprising at least one shoulder, the electronic casing comprises a mechanical structure comprising at least one mobile gripping jaw arranged so as to grasp the shoulder of the connector and to impart thereon a translational movement in said determined direction, thus facilitating the connection or the extraction of said electrical connector in its electrical socket.

Advantageously, the mechanical structure comprises a second mobile gripping jaw identical to the first mobile gripping jaw, each gripping jaw being arranged on either side of the socket and arranged so as to grasp the shoulder of the connector and to impart thereon a translational movement in said determined direction, thus facilitating the connection or the extraction of said electrical connector in its electrical socket.

Advantageously, each gripping jaw is mounted on a pivot, the movement of the mobile gripping jaw being a rotational movement about said pivot.

Advantageously, the axis of the pivot being at right angles to the determined direction, each gripping jaw comprises a lever, the tilting of the lever driving the tilting of the gripping jaw.

Advantageously, the axis of the pivot being parallel to the determined direction, each gripping jaw comprises two jaws, the upper part of the first jaw is in the form of an inclined disc, the lower part of the second jaw being arranged so as to leave a constant distance between the two jaws, said distance corresponding substantially to the thickness of the shoulder, each gripping jaw comprises a lever, the rotation of the lever driving the rotation of the jaws of the gripping jaw.

Advantageously, the gripping jaw is translationally mobile in a plane at right angles to the determined direction, each gripping jaw comprising a first jaw comprising a first inclined face arranged so as to slide under the shoulder and a second jaw comprising a second face of the same inclination and arranged so as to slide over the shoulder, the translation of the gripping jaw driving the translation of the electrical connector in the determined direction.

Advantageously, each gripping jaw comprises an immobilizing device for immobilizing in a determined position.

Advantageously, the electronic casing is an aeronautical instrument panel equipment item.

BRIEF DESCRIPTION OF THE DRAWINGS

The invention will be better understood and other advantages will become apparent on reading the following description, given in a nonlimiting manner and using the attached figures in which.

DETAILED DESCRIPTION

The locking and extraction device for an electrical connector is mounted on the rear face of an electronic casing. The latter comprises an electrical socket corresponding to the electrical connector to be mounted. The electrical connection between the connector and its socket is ensured with pins or electrical contacts. Generally, the connection system comprises several dozen of these electrical contacts. Hereinafter, the term "direction of connection" will be used to describe the direction parallel to the axis of the pins. The connection and the extraction of the electrical connector are performed in said direction.

In the locking device according to the invention, the connector is mounted in a mechanical assembly comprising a shoulder. This shoulder takes the general form of a flat plate surrounding the connector. Generally, the standard connectors have a shoulder of this type. The locking device according to the invention adapts easily to all types of shoulder.

In the device according to the invention, the electronic casing comprises a mechanical structure comprising at least one mobile gripping jaw arranged so as to grasp the shoulder of the connector and to impart thereon a translational movement in said determined direction, thus facilitating the connection or the extraction of said electrical connector in its electrical socket.

There are different embodiments of this type of locking device. FIGS. 1 to 5 represent a first embodiment.

Figure 1:
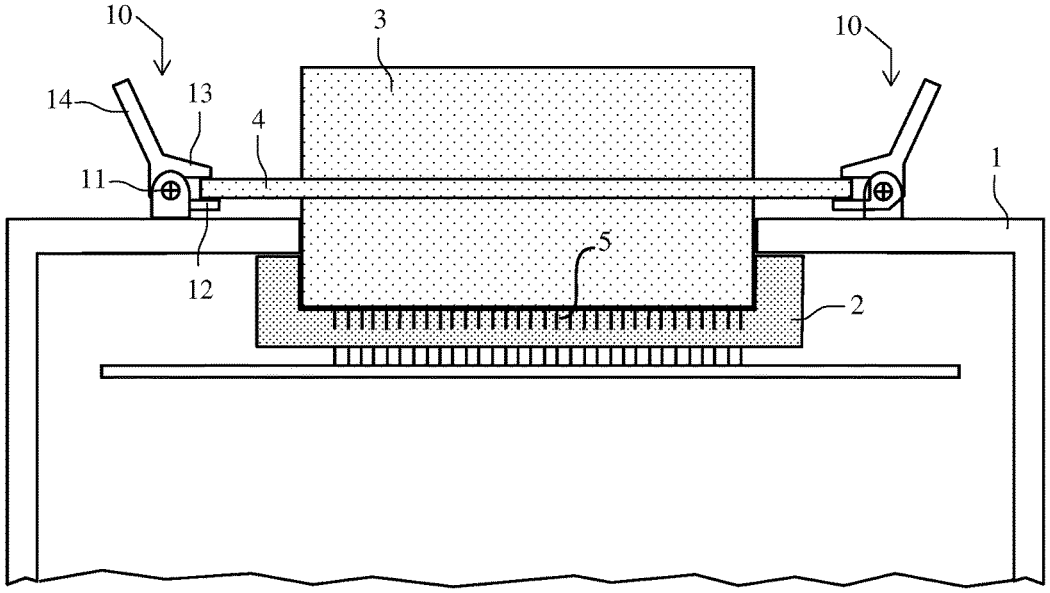
FIG. 1 represents a general view in cross section of a first embodiment of a locking device according to the invention.

In this first embodiment, the casing 1 represented schematically in partial cross section of FIG. 1 comprises two identical mechanical structures 10 arranged on either side of the location of the socket 2. Each structure 10 comprises a pivot 11, the axis of which is at right angles to the direction of extraction of the electrical connector 3. In the case of FIGS. 1 to 6, this axis is at right angles to the plane of the sheet.

Each structure also comprises an assembly comprising two jaws 12 and 13 and a lever 14. The assembly of the mechanical parts 12, 13 and 14 can rotate about the pivot 11. The distance between the jaws is set so as to be able to grasp the shoulder 4 of the electrical connector 3 with a minimum of mechanical play.

Figure 2:
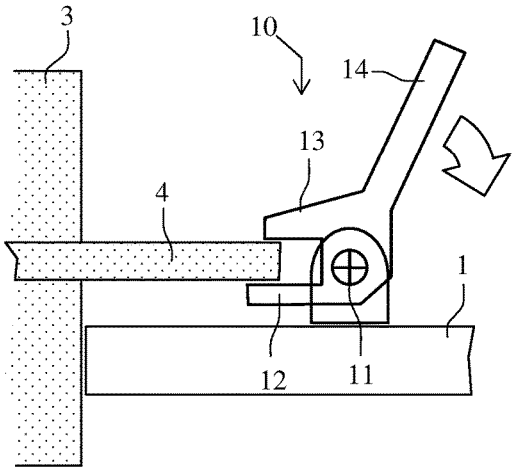
FIGS. 2, 3 and 4 represent the steps of implementation of the preceding locking device.
Figure 3:
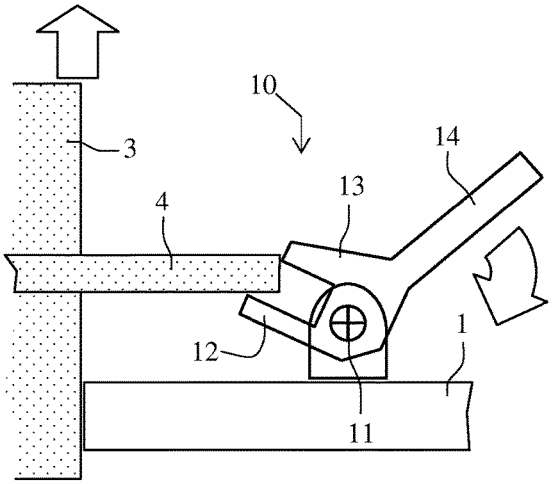
Figure 4:
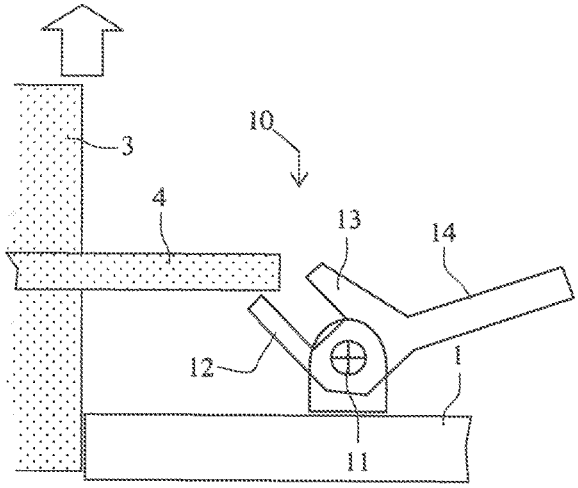

FIGS. 2, 3 and 4 represent the method for extracting the connector 3 from its socket 2. Obviously, the fitting of the connector 3 and electrical contacts 5 in its socket follows, without difficulty, the steps in reverse. In these figures and those which follow, the curved white arrows represent a rotational movement and the straight white arrows represent a translational movement.

When the connector 3 is fixed in its socket 2 as represented in FIG. 2, the shoulder 4 of the connector 3 is immobilized by the two gripping jaws 12 and 13 of the structures 10. By imparting a rotational movement symmetrically on the two levers 14, the jaws 12 are raised and drive the shoulder 4 of the connector in a translational movement which little-by-little frees the connector from its socket as can be seen in FIGS. 3 and 4. In these figures, the curved arrows are representative of the movement of the levers 14.

As can be seen in these figures, the length of the jaw 12 determines the extraction travel of the connector. The jaw 13 must be dimensioned to allow the shoulder 4 to escape. The length of these jaws is a function of mechanical parameters like the thickness of the shoulder and the extraction length. These mechanical parameters can easily be set by a person skilled in the art. To exert the sufficient extraction force, which can be of the order of several tens of kilograms, it is sufficient to engineer the arms of the levers 14 accordingly. It should be noted that it is not necessary for the translational movement to make it possible to fully extract the connector from its socket. In effect, it is generally sufficient to extract it by a few millimeters for the extraction force to then be sufficiently low. It is then possible to completely extract the connector by pulling on the top with no particular effort.

Figure 5:
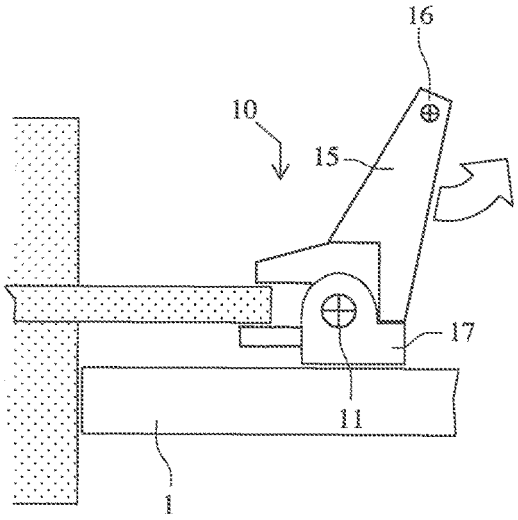
FIGS. 5 and 6 represent the preceding locking device comprising an immobilizing means.
Figure 6:
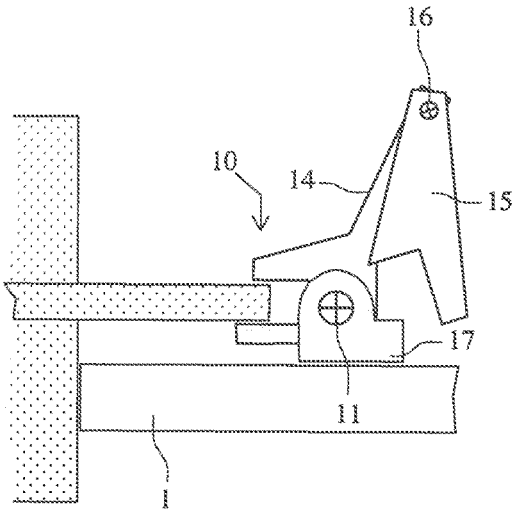

As can be seen in FIG. 2, in the connection position, the levers 14 are oriented virtually at right angles to the rear face of the casing. To prevent any false movement or impact from lowering them and provoking the partial or total disconnection of the connector, it is possible to arrange an immobilizing device on each lever which prevents the rotation thereof. FIGS. 5 and 6 represent an example of an it device. This immobilizing device comprises a mobile part 15 mounted on a pivot 16 arranged on the end of the lever 14. The mechanical structure which bears the pivot 11 comprises a shoulder 17 in which the mobile part 15 is housed when the lever 14 is in the connection position as can be seen in FIG. 5. In this case, any action on the lever 14 is impossible. To release the lever 14, it is sufficient to disengage the mobile part 15 from its casing.

Figure 7:
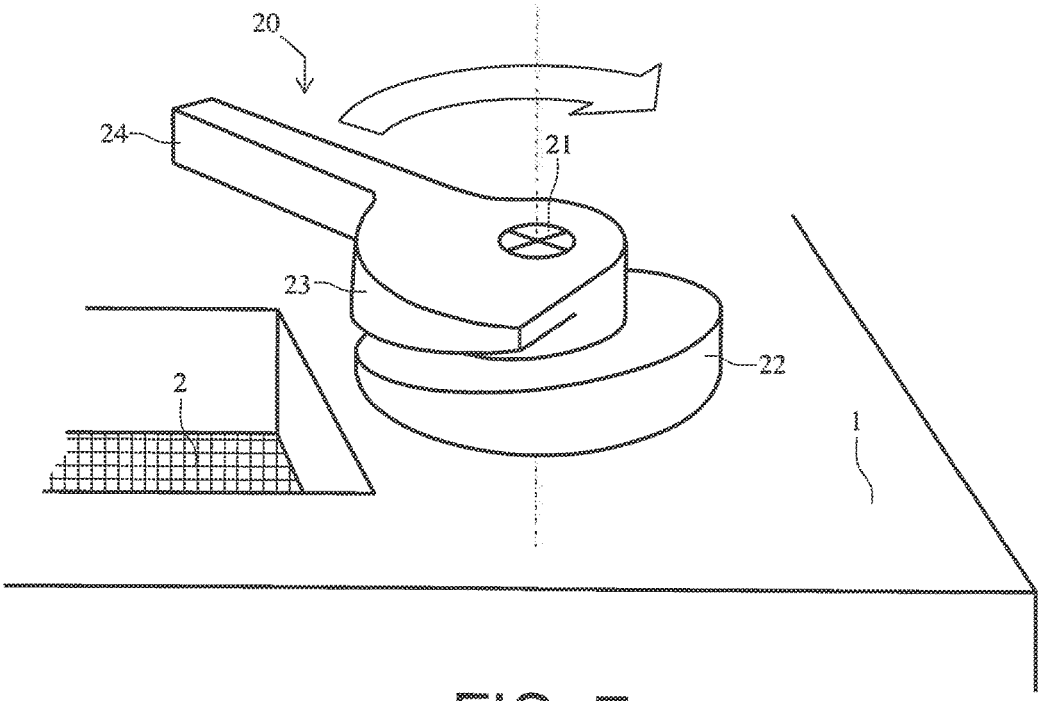
FIG. 7 represents a perspective view of a second embodiment of a locking device according to the invention.

A second embodiment is represented in FIG. 7. This figure is a partial perspective view of the part of the casing comprising a locking device according to the invention. For reasons of clarity, the connector 3 is not represented in this FIG. 7. In this second embodiment, the casing 1 comprises two identical mechanical structures 20 arranged on either side of the location of the socket 2. Just one of these structures is represented in FIG. 7.

Each structure 20 comprises a pivot 21, the axis of which is parallel to the direction of extraction of the electrical connector 3. It also comprises an assembly comprising two jaws 22 and 23 and a lever 24. The assembly of the mechanical parts 22, 23 and 24 can rotate about the pivot 21. The upper part of the first jaw 22 is in the form of an inclined disc, the lower part of the second jaw 23 is arranged so as to leave a constant distance between the two jaws, said distance corresponding substantially to the thickness of the shoulder 4. The rotation of the lever 24 drives the rotation of the jaws of the gripping jaw. Thus, when the lever 24 is rotated, the shoulder of the connector held between the jaws of the gripping jaw undergoes a translational movement which extracts or which inserts the connector in its socket depending on the direction of the movement.

The inclination of the disc of the jaw 22 makes it possible to set the extraction travel of the connector. The second jaw 23 has an angular width less than a complete revolution as can be seen in FIG. 7, so as to allow the shoulder of the connector to escape to disengage it from its socket. Here again, to exert the sufficient extraction force, it is sufficient to engineer the arms of the levers 24 accordingly.

Figure 8:
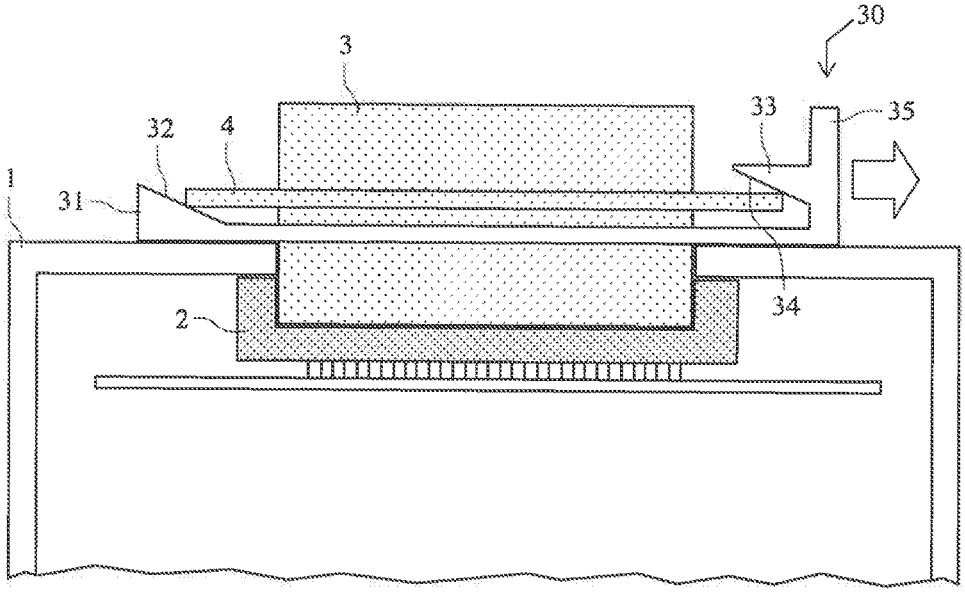
FIGS. 8, 9 and 10 represent a general view in cross section of a third embodiment of a locking device according to the invention and the implementation thereof.
Figure 9:
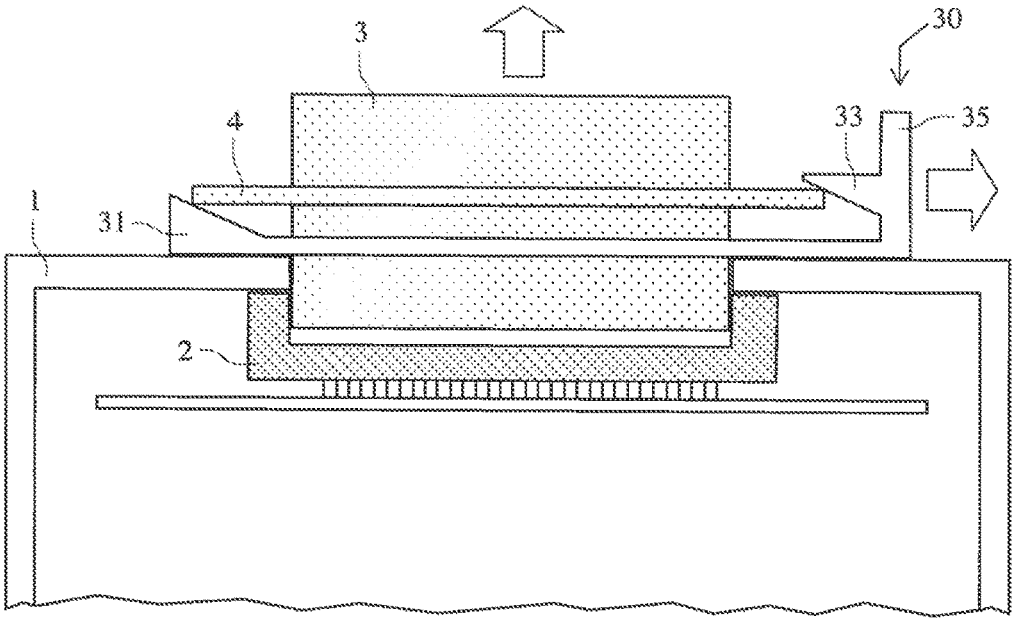
Figure 10:
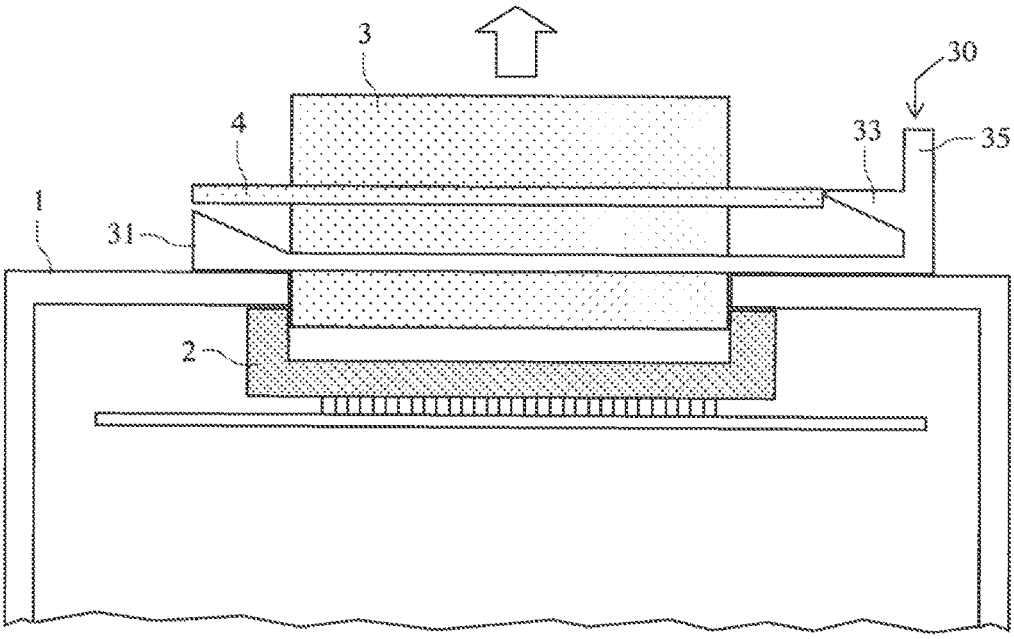

A third embodiment is represented in FIGS. 8, 9 and 10. These figures schematically represent, in partial cross section, the part of the casing 1 comprising the socket 2 and its connector 3. In this last exemplary embodiment, the gripping jaw is mounted in a structure 30 or slideway that is translationally mobile in a plane at right angles to the direction of connection of the electrical contacts and parallel to the plane of the rear face of the casing. The structure comprises oblong holes, the direction of which is parallel to the direction of translation thereof and held in place and directed translationally by fixing means passing through said oblong holes. These means are not represented in FIGS. 8 to 10.

Each gripping jaw comprises a first jaw, called bottom jaw 31 comprising a first inclined face 32 arranged so as to slide under the shoulder 4 of the connector 3 and a second jaw, called top jaw 33, comprising a second face 34 of the same inclination and arranged so as to slide over the shoulder 4. The two jaws are mounted head-to-tail. The first jaw is arranged at one of the ends of the connector and the second jaw at the opposite end. The jaws can occupy the entire width of the shoulder or only a part thereof. The distance which separates them and their height difference are imposed by the geometrical characteristics of the shoulder.

The translation of the gripping jaw drives the translation of the electrical connector 3 in the direction of extraction as can be seen in FIGS. 8 and 9. The translational travel of the connector is set by the height of the inclined faces and the force to be exerted on the mobile structure to raise or to lower the connector by inclination of said inclined faces. The lower the inclination, the greater the lever arm. When the shoulder escapes from the jaws, the connector can be removed from its socket with no significant effort.

The translation of the structure 30 can be facilitated by a handle 35 as can be seen in FIGS. 8 to 10.

In a first variant embodiment, the structure comprises only a first jaw 31 and a second jaw 33 as indicated in FIGS. 8 to 10. In a second variant embodiment, the structure can comprise a number of pairs of jaws 31 and 33 arranged regularly along the shoulder. In this case, the shoulder comprises slots allowing the different jaws to raise or lower the connector.

As stated, the locking and extraction device for an electrical connector in an electronic casing according to the invention is more notably intended for aeronautical applications and most particularly for the equipment items mounted on the front face of the instrument panel. Once the connector is mounted, the casing is then positioned in its housing in the instrument panel.

What is claimed is:

1. A locking and extraction device for an electrical connector in an electronic casing, said electronic casing comprising an electrical socket corresponding to said electrical connector, a connection and an extraction of the electrical connector being performed in a determined direction, parallel to electrical contacts of the electrical connector, wherein, said connector being mounted in a mechanical assembly comprising at least one shoulder, the electronic casing comprises a mechanical structure comprising at least one mobile gripping jaw arranged so as to grasp the shoulder of the connector and to impart thereon a translational movement in said determined direction, thus facilitating the extraction of said electrical connector from its electrical socket, each gripping jaw being mounted on a pivot, a movement of the mobile gripping jaw being a rotational movement about said pivot, the axis of the pivot being parallel to the determined direction, each gripping jaw comprises two jaws, the upper part of the first jaw is in the form of an inclined disc, the lower part of the second jaw being arranged so as to leave a constant distance between the two jaws, said distance corresponding substantially to the thickness of the shoulder, each gripping jaw comprises a lever, the rotation of the lever driving the rotation of the jaws of the gripping jaw.

2. The locking and extraction device for an electrical connector according to claim 1, wherein the mechanical structure comprises a second mobile gripping jaw identical to the first mobile gripping jaw, each gripping jaw being arranged on either side of the socket and arranged so as to grasp the shoulder of the connector and to impart thereon a translational movement in said determined direction, thus facilitating the connection or the extraction of said electrical connector in its electrical socket.

3. The locking and extraction device for an electrical connector according to claim 1, wherein each gripping jaw comprises an immobilizing device for immobilizing in a determined position.

4. The locking and extraction device for an electrical connector according to claim 1, wherein the electronic casing is an aeronautical instrument panel equipment item.

* * * * *